US012584326B2

(12) United States Patent
McDuffie et al.

(10) Patent No.: US 12,584,326 B2
(45) Date of Patent: Mar. 24, 2026

(54) POOL GUTTER AND WALL ASSEMBLY

(71) Applicant: Paddock Pool Equipment Company, Rock Hill, SC (US)

(72) Inventors: Michael McDuffie, Fort Mill, SC (US); Phillip Thorne, Rock Hill, SC (US)

(73) Assignee: Paddock Pool Equipment Company, Rock Hill, SC (US)

( * ) Notice: Subject to any disclaimer, the term of this patent is extended or adjusted under 35 U.S.C. 154(b) by 349 days.

(21) Appl. No.: 18/328,523

(22) Filed: Jun. 2, 2023

(65) Prior Publication Data

US 2024/0401355 A1 Dec. 5, 2024

(51) Int. Cl.
*E04H 4/12* (2006.01)

(52) U.S. Cl.
CPC ..... *E04H 4/1227* (2013.01)

(58) Field of Classification Search
CPC ..... E04H 4/1218; E04H 4/1227
See application file for complete search history.

(56) References Cited

U.S. PATENT DOCUMENTS

| | | | | |
|---|---|---|---|---|
| 4,007,566 | A * | 2/1977 | Molitor | E04H 4/1227 52/169.7 |
| 4,094,022 | A * | 6/1978 | Protano | E04H 4/1227 137/123 |
| 4,464,802 | A * | 8/1984 | Glonek | E04H 4/0043 52/169.7 |
| 4,669,133 | A * | 6/1987 | Blecher | A47K 3/161 4/584 |
| 4,672,693 | A * | 6/1987 | Schenstrom | A47K 3/022 292/145 |
| 9,827,750 | B2 | 11/2017 | Lookebill et al. | |
| 10,697,697 | B2 | 6/2020 | Cur et al. | |
| 11,375,856 | B1 * | 7/2022 | Kircher | A47K 3/14 |
| 2023/0340790 | A1 | 10/2023 | Taylor, Jr. et al. | |

* cited by examiner

*Primary Examiner* — Erin Deery
(74) *Attorney, Agent, or Firm* — Greer, Burns & Crain Ltd.

(57) ABSTRACT

A pool structure assembly that includes a wall including at least one hook member, where the at least one hook member is rotatably connected to the wall. The pool structure assembly further includes a gutter assembly including at least one pin member and a seal member positioned between the gutter assembly and the wall, where the hook member is rotated into engagement with the pin member causing the gutter assembly to move into sealed engagement with the wall.

10 Claims, 6 Drawing Sheets

POOL GUTTER AND WALL ASSEMBLY

BACKGROUND

This disclosure relates to structures for pools including gutter assemblies that direct water from the pool to a filtration system and wall assemblies that form a structural perimeter of a pool and support the gutter assemblies.

A swimming pool includes walls forming a perimeter of the pool and a bottom wall that combine to define a space for receiving water. The walls are typically panels made of metal or cement that are attached to a frame, and more specifically, to vertically oriented studs of the frame. The panels used for the walls have a designated height and length based on the size of the swimming pool being constructed and have a designated thickness for insulation and support. Constructing the walls is labor intensive due to the size and weight of the materials that form the wall panels. Additionally, attaching the gutter assemblies to the top surfaces of the walls requires the gutter assemblies to be welded or secured to the walls using fasteners, which adds to the time and cost associated with the construction of the swimming pool.

Moreover, attaching the gutter assemblies to the top surfaces of the walls creates a space between the gutter assemblies and the walls that may lead to leaking of water in that space thereby causing water loss from the swimming pool and possible water damage to the pool structure.

It is therefore desirable to provide a structurally sound and sealed structure for a swimming pool while also reducing costs associated with the labor and materials needed to construct the swimming pool.

Accordingly, the present invention addresses the requirements for constructing walls for the perimeter of a swimming pool and the gutter assemblies on the walls that are efficiently sealed together while reducing costs associated with the time and materials for constructing the swimming pool.

SUMMARY

The present invention is directed to a pool structure having at least one wall and at least one gutter assembly on the wall where a seal connector enables the at least one gutter assembly to be efficiently secured to the wall to form a sealed connection between the gutter assembly and the wall and help minimize assembly time and materials associated with the pool.

In an embodiment, a pool structure assembly is provided and includes a wall including at least one hook member, where the at least one hook member is rotatably connected to the wall. The pool structure assembly further includes a gutter assembly including at least one pin member and a seal member positioned between the gutter assembly and the wall, where the hook member is rotated into engagement with the pin member causing the gutter assembly to move into sealed engagement with the wall.

In another embodiment, a pool structure assembly is provided and includes a wall including an insulating panel and a channel and a slot in communication with the channel. The pool structure assembly further includes a hook assembly in the wall, where the hook assembly includes a frame, a hook member rotatably connected to the frame and a rod extending from an end of the hook member, where at least a portion of the hook member extends outwardly from the slot in the wall and the rod extends from the end of the hook member through the channel to an outer surface of the wall. A gutter assembly is positioned on a top end of the wall and has a closed compartment with a slot and a seal connector in the closed compartment. The seal connector includes a pin assembly having a pin member and a seal member positioned between the gutter assembly and the wall, where the hook member extends through the slot in the closed compartment and is rotated into engagement with the pin member causing the gutter assembly to move into sealed engagement with the wall.

DETAILED DESCRIPTION

The present invention is directed to a pool structure including a wall assembly that efficiently connects a pool gutter assembly to a top surface of a pool wall while forming a seal between the gutter assembly and the wall.

Figure 1:
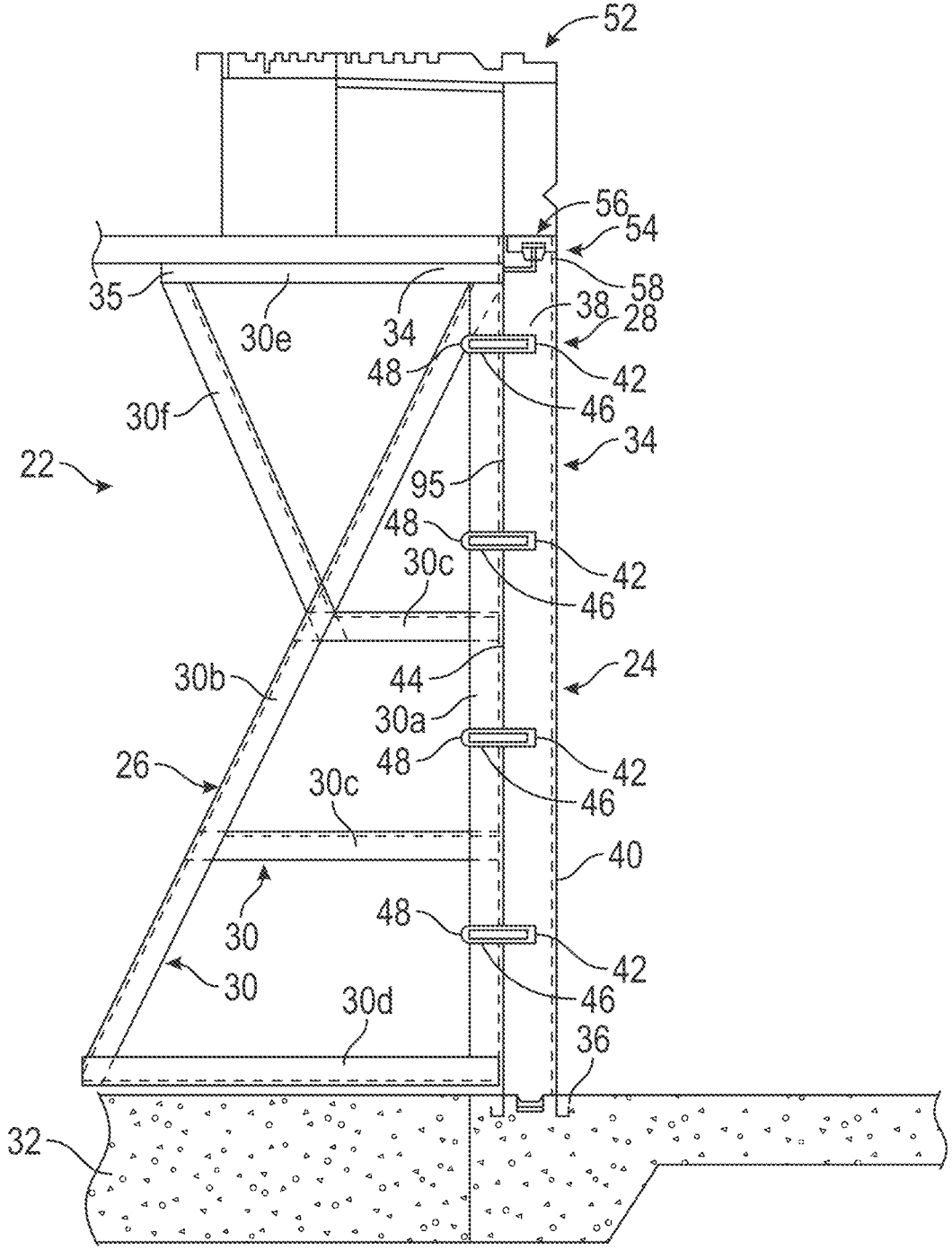
FIG. 1 is a side view of an embodiment of a pool gutter and wall assembly of the present invention.

Referring now to FIGS. 1 to 6C, an embodiment of a pool structure assembly is shown and generally indicated as 22, where a wall structure 24 includes a support frame 26 and a wall assembly 28 attached to the support frame. As shown in FIG. 1, the support frame 26 includes a plurality of support members 30, such as metal studs, that are connected together by bolts, rivets, welding or other suitable fasteners or attachment methods. Specifically, the support frame 26 includes a vertical support member 30*a* and a first angled support member 30*b* where the top ends of the vertical support member 30*a* and the first angled support member 30*b* are connected together. A plurality of horizontal support members 30*c* extend between and are connected to the first angled support member 30*b* and the vertical support member 30*a*. The bottom horizontal support member 30*d* is anchored to an underlying support structure 32, such as a foundation or the ground, and connected to leveling components (not shown) to adjust the angle of the bottom horizontal support member 30*d*, and thereby the support frame 26, relative to the underlying support structure 32. The support frame 26 further includes a top horizontal support member 30*e* having a first end 34 that is connected to the top ends of the first angled support member 30*b* and the vertical support member 30*a*. The opposing second end 35 of the top horizontal support member 30*e* is connected to a second angled support member 30*f* that is also connected to the first angled support member 30*b* as shown in FIG. 1. It should be appreciated that the support members 30 of the support frame 26 may be arranged and connected together in any suitable configuration to support the gutter assemblies and walls of the pool.

A plurality of pool walls 34 are arranged end-to-end and attached to the support frame 26 to form the perimeter of the pool. The walls are seated on and secured to a floor or bottom wall 36 that is part of the underlying support structure 32 and made of cement, a synthetic material, such as a resin or polymer, or any suitable material or combination of materials. The combination of the pool walls 34 and the bottom wall 36 define an internal space configured to receive water. After assembly, the seams between the pool walls 34 and between the pool walls 34 and the bottom wall 36 are sealed by a sealing material to help prevent water from leaking out of the pool.

As shown in FIG. 1, each of the pool walls 34 includes an insulating panel 38 made with a foam material, that is adjacent to the support frame 26. In an embodiment, a liner 40, preferably made with a polymer material, is adjacent to and secured to the inner surface of the insulating panel 38 using bonding material such as a resin or adhesive. It should be appreciated that the liner 40 may be made with a polymer material, a polyvinyl chloride (PVC) material, a plastic material, a metal, such as stainless steel, or any suitable material or combination of materials. Each of the insulating panels 38 includes a plurality of threaded receptacles 42 that are formed or embedded in the insulating panel. The vertical support member 30*a* of the support frame 26 includes through-holes 46 corresponding with the threaded receptacles 42 in the insulating panel 38 such that the through-holes 46 align with the threaded receptacles 42 when the insulating panel 38 is positioned adjacent to vertical support member 30*a*. A fastener 48, such as a threaded bolt, is inserted through each of the through-holes 46 and threaded into the corresponding threaded receptacles 42 in the insulating panel 38 to secure the insulating panel 38 to the support frame 26. In another embodiment, the fasteners 48 are self-tapping threaded fasteners that extend through the support frame 26 and at least partially into the insulating panel 38 to secure the insulating panel to the support frame. It should be appreciated that the insulating panel 38 may be secured to the support frame 26 using any suitable fasteners or fastening methods. In another embodiment shown in FIG. 7, an inner wall 112 of the pool includes an insulating panel 114 and a covering material 116 such as a polymer material or PVC material described above or a coating made of a pourable material such as cement, a polymer material, or other suitable material or combination of materials that may be spread over the surface 118 of the insulating panel 114 and the seams between the insulating panels and set to form a solid, sealed inner surface of the inner wall 112.

Figure 2:
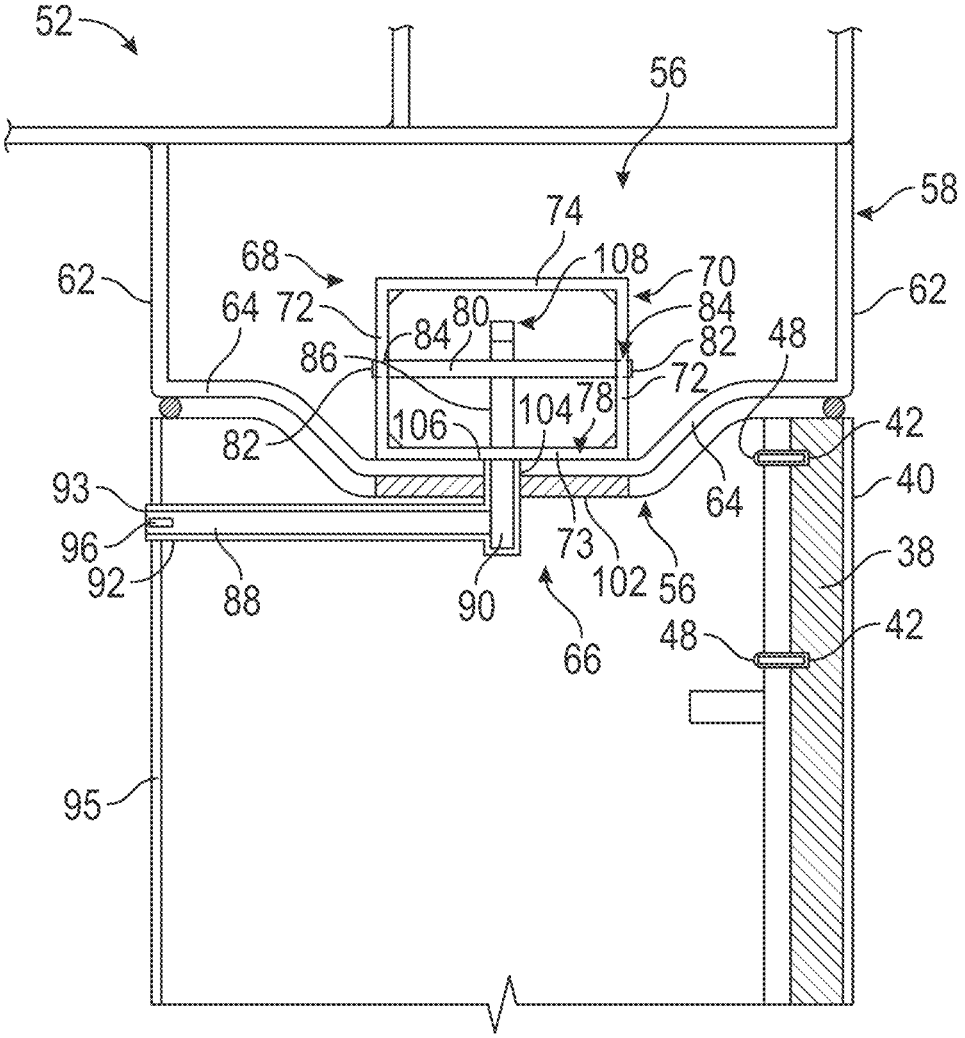
FIG. 2 is an enlarged fragmentary view of a seal connector of the pool gutter and wall assembly of FIG. 1.

A gutter assembly or a plurality of gutter assemblies 52 are secured to a top end 54 of each wall 34 by a seal connector 56. As shown in FIG. 2, each seal connector 56 is contained within a closed compartment 58 at a bottom end of the gutter assembly 52 formed by opposing sidewalls 62 and a bottom wall 64, and includes a hook assembly 66 and a pin assembly 68. The pin assembly 66 includes a pin frame 70 having opposing sidewalls 72, a bottom wall 73, a top wall 74 and a rear wall 75 that are secured together by welding or other suitable attachment method. The bottom wall 73 is secured in a recessed area 78 formed by the bottom wall 64 of the gutter assembly 52 by welding, fasteners or a suitable attachment method. A cylindrical pin member 80 extends between the opposing sidewalls 72 at a height that is between the bottom wall 73 and the top wall 74. The ends 82 of the cylindrical pin member 80 are inserted in holes 84 in the opposing sidewalls 72 and fixed to the opposing sidewalls 72 by welding, a suitable adhesive or other suitable attachment method.

The hook assembly 66 includes a hook member 86 and a rod 88 that is transverse to and extends from an end 90 of the hook member. The rod 88 is positioned in an access channel 92 formed in the insulating panel 38 and through-holes 93 formed in the outer wall 95. As shown, the rod 88 has a length that extends from the end 90 of the hook member 86 and through the access channel 92 and through-hole 93 to an outer surface of the outer wall 95. The access channel 92 has a width or diameter that is greater than a width or diameter of the rod 88 and enables the rod to rotate within the access channel 92. The hook member 86 and the rod 88 are preferably made of a metal, such as stainless steel, but may be made with any suitable material or combination of materials. The outer end of the rod 88 includes a recessed key 96 that is engaged by a tool (not shown) having an end that fits in the key 96 and enables the rod 88 and thereby the hook member 86 to be rotated by the tool.

Figure 3:
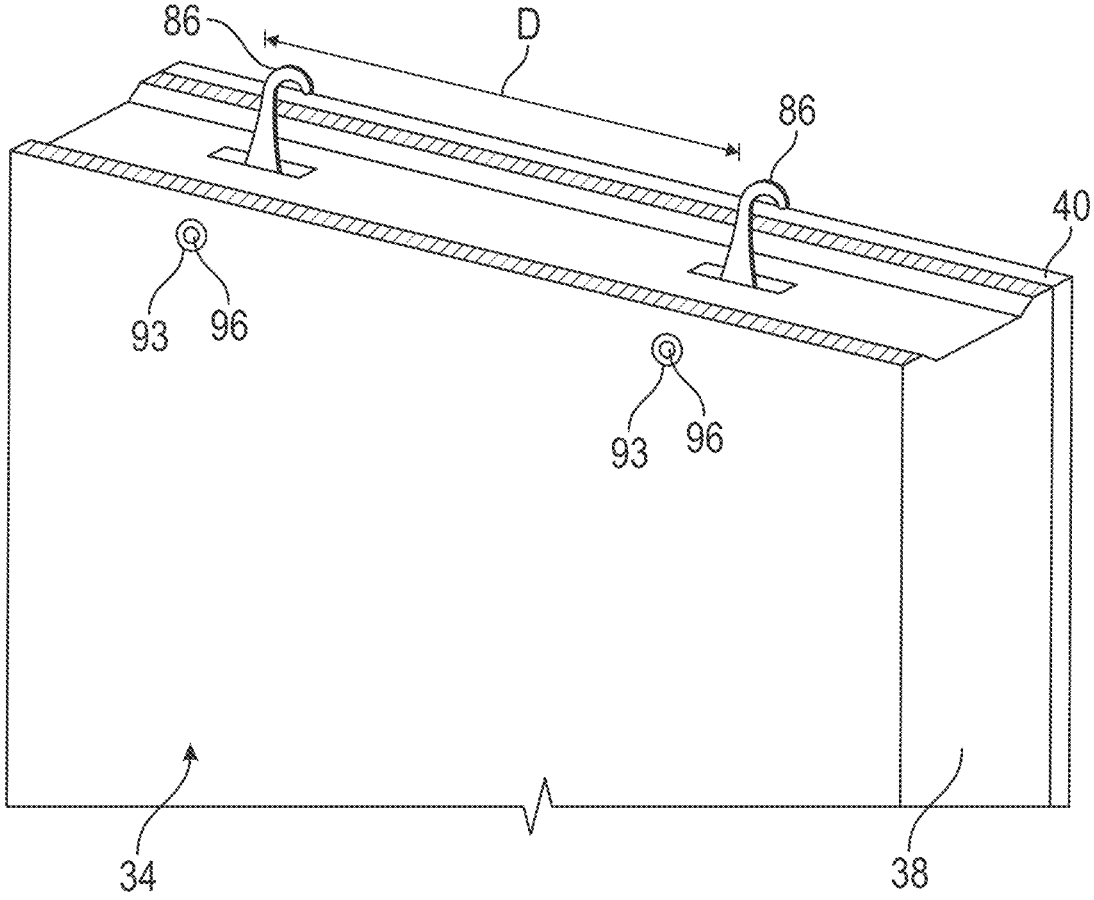
FIG. 3 is a fragmentary perspective view of a wall of the pool gutter and wall assembly of FIG. 1.
Figure 4:
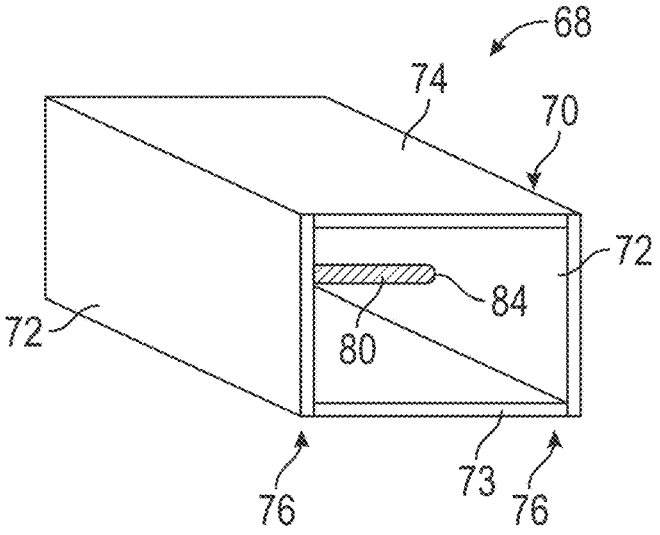
FIG. 4 is a perspective view of a pin assembly of the seal connector of FIG. 2.
Figure 5A:
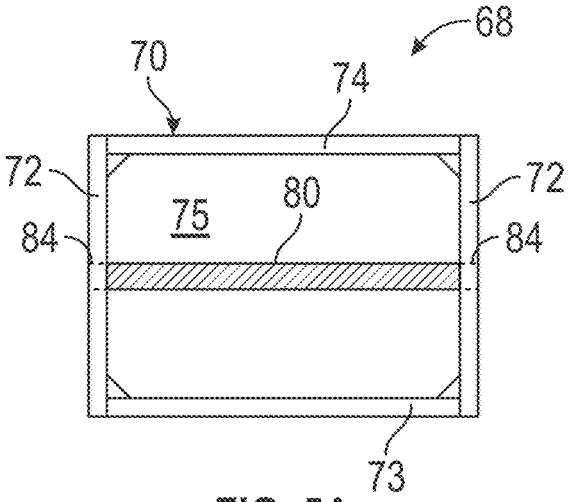
FIG. 5A is a front view of the pin assembly of FIG. 4.
Figure 5B:
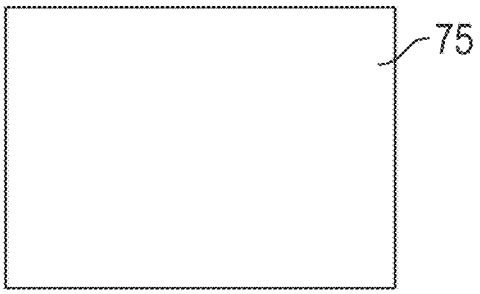
FIG. 5B is a rear view of the pin assembly of FIG. 4.

As shown in FIGS. 3, 6A, 6B and 6C, a portion of the hook member 86 extends outwardly from a slot 98 formed in the top end 54 of each wall 34, where each wall 34 includes at least one seal connector 56 having the hook member 86, and preferably a plurality of the seal connectors 56 each having the hook member 86 as shown in FIG. 3. To connect the gutter assemblies 52 to the top ends 54 of the walls 34, the bottom walls 58 of the gutter assemblies 34 are each formed with a shape that corresponds to the shape of the top surfaces of the walls 34 so that the bottom walls 64 of the gutter assemblies 52 matingly engage the top surfaces of the walls 34. Additionally, a seal member 102 having a generally planar shape and made of rubber or other suitable sealing material, is placed between each of the gutter assemblies 52 and the top ends 54 of the walls 34. The seal member 102 includes a slot 104 corresponding to the slots 98 on the top ends 54 of the walls 34 and slots 106 in the bottom walls 64 of the gutter assemblies 52. After the gutter assembly 52 with the bottom wall 64 is seated on the top end 54 of the wall 34, the hook member 86 extends through the slot 104 in the seal member 102 and the slot 106 in the bottom wall 64 the gutter assembly 52 and is configured to rotationally engage the hook member 86.

Figure 6B:
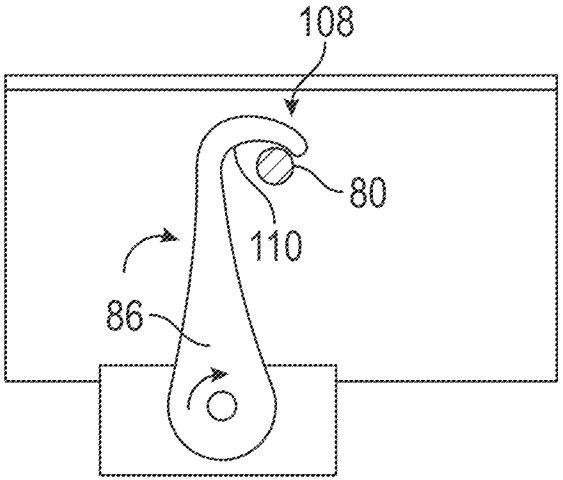
FIG. 6B is an enlarged, fragmentary sectional view of the hook assembly of FIG. 6A, where the hook is in a second position.
Figure 6A:
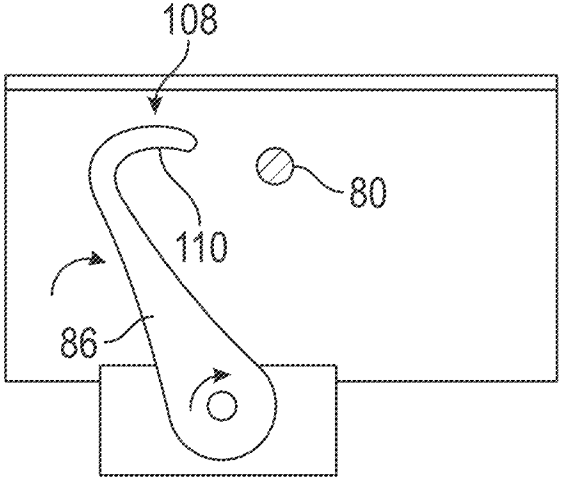
FIG. 6A is an enlarged, fragmentary sectional view of a hook assembly of the seal connector of FIG. 2, where the hook is in a first position.
Figure 6C:
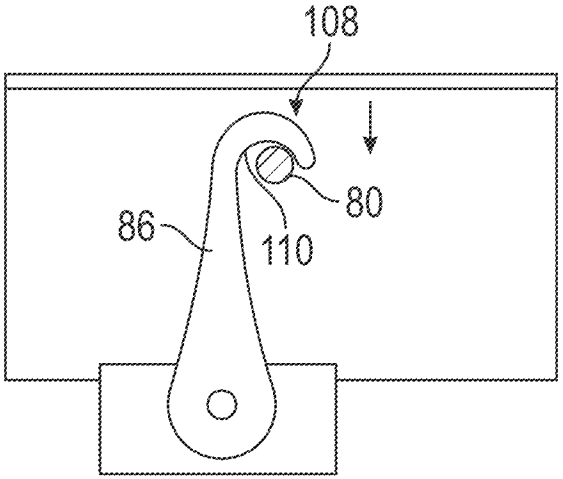
FIG. 6C is an enlarged, fragmentary sectional view of the hook assembly of FIG. 6A, where the hook is in a third position.

As shown in the illustrated embodiment, the hook member 86 includes an end 108 having a cam-shaped surface 110 so that as the hook member 86 engages the pin member 80, the pin member 80 moves along the cam-shaped surface 110 of the hook member 86 as the hook member rotates toward the pin member 80. As shown in FIGS. 6A, 6B and 6C, the cam-shaped surface 110 of the end 108 of the hook member 86 gradually pulls the pin member 80 and thereby the gutter assembly 52 toward the wall 34 until reaching the final position of the hook member shown in FIG. 6C. The engagement of the hook member 86 with the pin member 80 secures the gutter assembly 52, the seal member 102 and the top end 54 of the wall 34 together thereby forming a secure seal between the gutter assembly 52 and the wall 34. It should be appreciated that the surface of the hook member 86 may have any suitable shape that moves the gutter assembly 52 toward the wall 34.

In operation, the walls 34 and bottom wall 36 of the pool are inserted or formed in a hole in the ground or other structure and secured to the support frame 26 as described above. The adjacent ends of the walls 34 are attached together by welding, rivets, fasteners or any suitable attachment method. The bottom walls 64 of the gutter assemblies 52 are seated on the top ends 54 of the walls 34 so that the hook members 86 of the seal connectors 100 extend through the slots 98 in the walls 34, the slots in the seal members 102 and the slots 106 in the bottom walls 64 of the gutter assemblies 52. An end of a tool is inserted in the key 96 in the end of each rod 88 in the wall 34 and the tool is rotated in a clockwise direction, which in turn, rotates the rod 88 and the hook member 86 as shown in FIGS. 6A and 6B, until the hook member 86 is in the final position shown in FIG. 6C, i.e., in engagement with the pin member 80. In this position, each gutter assembly 52 is sealed and secured to the top end 54 of the wall 34. To remove the gutter assembly 52 from the wall 34, the end of the tool is inserted in the key 96 and the tool is rotated in a counter-clockwise direction to correspondingly rotate that rod 88 and the hook member 86 in a counter-clockwise direction to remove the hook member 86 from the pin member 80 and enable the gutter assembly 52 to be removed from the top end 54 of the wall 34.

Figure 7:
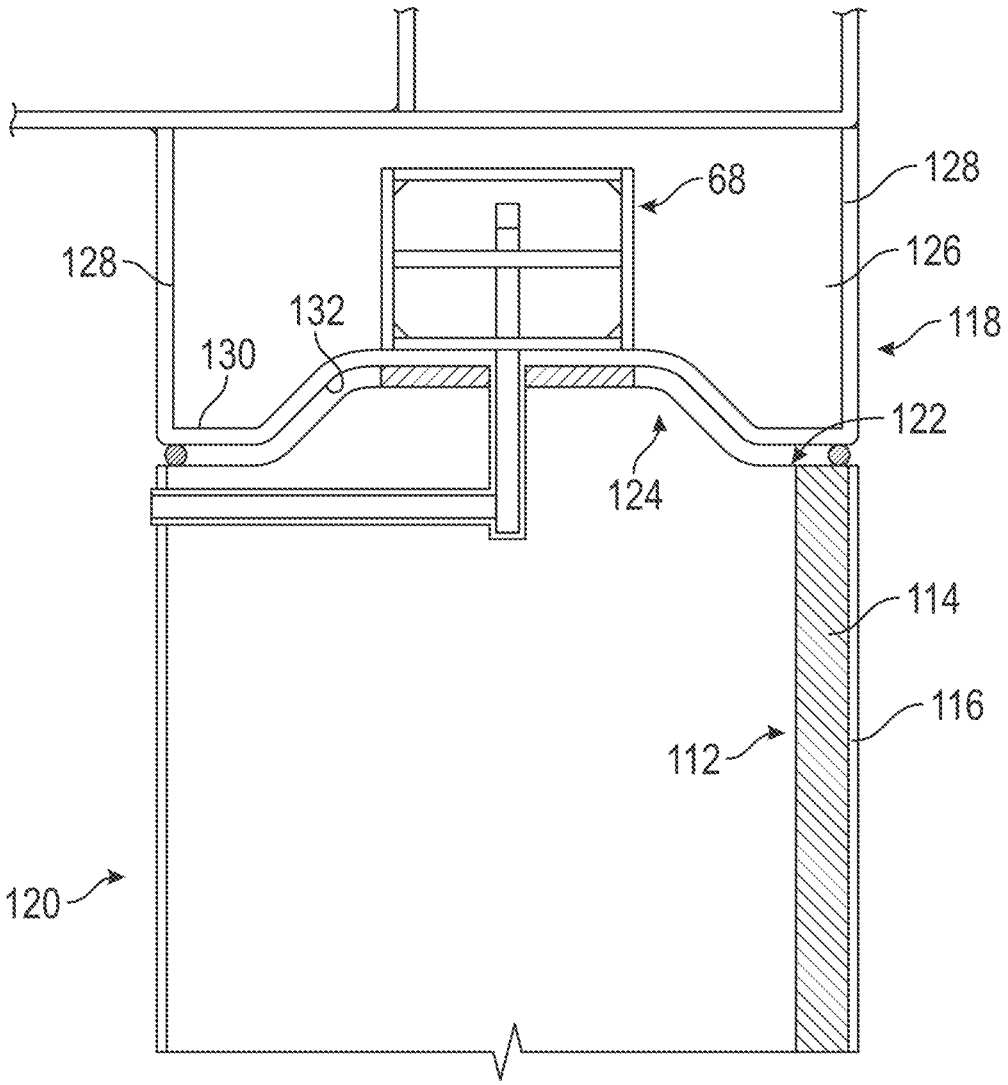
FIG. 7 is an enlarged fragmentary view of another embodiment of the seal connector of the pool gutter and wall assembly of FIG. 1.

Referring to FIG. 7, another embodiment of the gutter assembly 118 and the wall 120 is shown where the top end 122 of the wall 120 includes a protruding portion 124 that extends upwardly from the top end 122 of the wall 120. The gutter assembly 118 includes a closed compartment 126 formed by opposing walls 128 and a bottom wall 130 where the bottom wall defines a recessed portion 132. As shown in the illustrated embodiment, the recessed portion 132 of the bottom wall 130 of the gutter assembly 118 matingly engages the protruding portion 124 of the wall 120 when the gutter assembly 118 is seated on and secured to the wall 120 as described above. It should be appreciated that the bottom wall 130 of the gutter assembly 118 and the top end 122 of wall 120 may have any suitable shape or configuration that enables the gutter assembly 118 to be seated on and secured to the wall 120.

While particular embodiments of the present pool structure assembly are shown and described, it will be appreciated by those skilled in the art that changes and modifications may be made thereto without departing from the invention in its broader aspects and as set forth in the following claims.

What is claimed is:

1. A pool structure assembly comprising:

a wall including an insulating panel and a channel and a slot in communication with the channel;

a hook assembly in said wall, said hook assembly including frame, a hook member rotatably connected to the frame and a rod extending from an end of the hook member, at least a portion of the hook member extending outwardly from said slot in said wall and said rod extending from the end of the hook member through said channel to an outer surface of said wall;

a gutter assembly having a closed compartment with a slot and a seal connector in said closed compartment, said seal connector including a pin assembly having a pin member; and a seal member positioned between the gutter assembly and the wall, wherein the hook member extends through the slot in the closed compartment and is rotated into engagement with the pin member causing the gutter assembly to move into sealed engagement with the wall.

2. The pool structure of claim 1, wherein a plurality of the hook assemblies are included in the wall, and a plurality of gutter assemblies are positioned on the wall, and wherein the hook members of the plurality of hook assemblies are rotated into engagement with the pin members of the plurality of gutter assemblies.

3. The pool structure of claim 1, wherein said rod includes a recessed key configured to receive a tool, wherein rotation of the tool rotates the rod and the hook member.

4. The pool structure of claim 1, wherein the seal member is made of rubber.

5. The pool structure of claim 1, wherein the hook member includes an end having a cam shape.

6. The pool structure of claim 1, wherein the insulating panel is made of a foam material.

7. A pool structure assembly comprising:

a wall including at least one hook member, wherein the at least one hook member is rotatably connected to the wall;

a gutter assembly including at least one pin member; and a seal member positioned between the gutter assembly and the wall, wherein the hook member is rotated into engagement with the pin member causing the gutter assembly to move into sealed engagement with the wall, wherein a top end of the wall includes a slot and a bottom end of the gutter assembly includes a slot, wherein the slot at the top end of the wall and the slot at the bottom end of the gutter assembly align with each other when the gutter assembly is seated on the wall, and at least a portion of the hook member extends through the slot on the top end of the wall and the slot at the bottom end of the gutter assembly.

8. The pool structure of claim 7, further comprising a hook assembly including a rod attached to an end of the hook member, said rod being transverse to and extending from the end of the hook member.

9. The pool structure of claim 8, wherein said rod includes a recessed key configured to receive a tool, wherein rotation of the tool rotates the rod and the hook member.

10. The pool structure of claim 8, wherein the wall includes a channel and said rod extends from the end of the hook member and through the channel to an outer surface of the wall.

* * * * *